US009026028B2

(12) United States Patent
Nishimura

(10) Patent No.: US 9,026,028 B2
(45) Date of Patent: May 5, 2015

(54) IMAGE FORMING APPARATUS

(71) Applicant: Fuji Xerox Co., Ltd., Minato-ku, Tokyo (JP)

(72) Inventor: Koji Nishimura, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 61 days.

(21) Appl. No.: 13/765,190

(22) Filed: Feb. 12, 2013

(65) Prior Publication Data

US 2014/0023414 A1 Jan. 23, 2014

(30) Foreign Application Priority Data

Jul. 20, 2012 (JP) ..... 2012-161827

(51) Int. Cl.
*G03G 21/10* (2006.01)
*G03G 15/16* (2006.01)

(52) U.S. Cl.
CPC ..... *G03G 21/105* (2013.01); *G03G 15/161* (2013.01); *G03G 2215/0129* (2013.01)

(58) Field of Classification Search
CPC ..... G03G 15/0178; G03G 15/0189; G03G 15/0194; G03G 2215/0122; G03G 2215/0125; G03G 2215/0138; G03G 2215/0141
USPC ..... 399/223, 231, 299
See application file for complete search history.

(56) References Cited

U.S. PATENT DOCUMENTS

2008/0118290 A1* 5/2008 Sato ..... 399/358
2008/0317495 A1* 12/2008 Hyakutake et al. ..... 399/101
2010/0080638 A1* 4/2010 Ichikawa et al. ..... 399/358
2011/0236043 A1* 9/2011 Masui ..... 399/39

FOREIGN PATENT DOCUMENTS

JP 2007-148147 A 6/2007

* cited by examiner

*Primary Examiner* — Gregory H Curran
(74) *Attorney, Agent, or Firm* — Sughrue Mion, PLLC

(57) ABSTRACT

An image forming apparatus includes a first image forming unit that forms an image by using a first toner having a first average particle diameter, a second image forming unit that forms an image by using a second toner having a second average particle diameter that is greater than the first average particle diameter, and a transport path through which the first and second toners collected from the first and second image forming units, respectively, are transported. The transport path is configured such that a position at which the second toner is collected from the second image forming unit is located upstream of a position at which the first toner is collected from the first image forming unit in a transporting direction of the transport path.

8 Claims, 6 Drawing Sheets

IMAGE FORMING APPARATUS

CROSS-REFERENCE TO RELATED APPLICATIONS

This application is based on and claims priority under 35 USC 119 from Japanese Patent Application No. 2012-161827 filed Jul. 20, 2012.

BACKGROUND

1. Technical Field

The present invention relates to an image forming apparatus.

2. Summary

According to an aspect of the invention, there is provided an image forming apparatus including a first image forming unit that forms an image by using a first toner having a first average particle diameter, a second image forming unit that forms an image by using a second toner having a second average particle diameter that is greater than the first average particle diameter, and a transport path through which the first and second toners collected from the first and second image forming units, respectively, are transported. The transport path is configured such that a position at which the second toner is collected from the second image forming unit is located upstream of a position at which the first toner is collected from the first image forming unit in a transporting direction of the transport path.

BRIEF DESCRIPTION OF THE DRAWINGS

Exemplary embodiments of the present invention will be described in detail based on the following figures, wherein.

DETAILED DESCRIPTION

Exemplary embodiments of the present invention will now be described with reference to the drawings.

First Exemplary Embodiment

Figure 1:
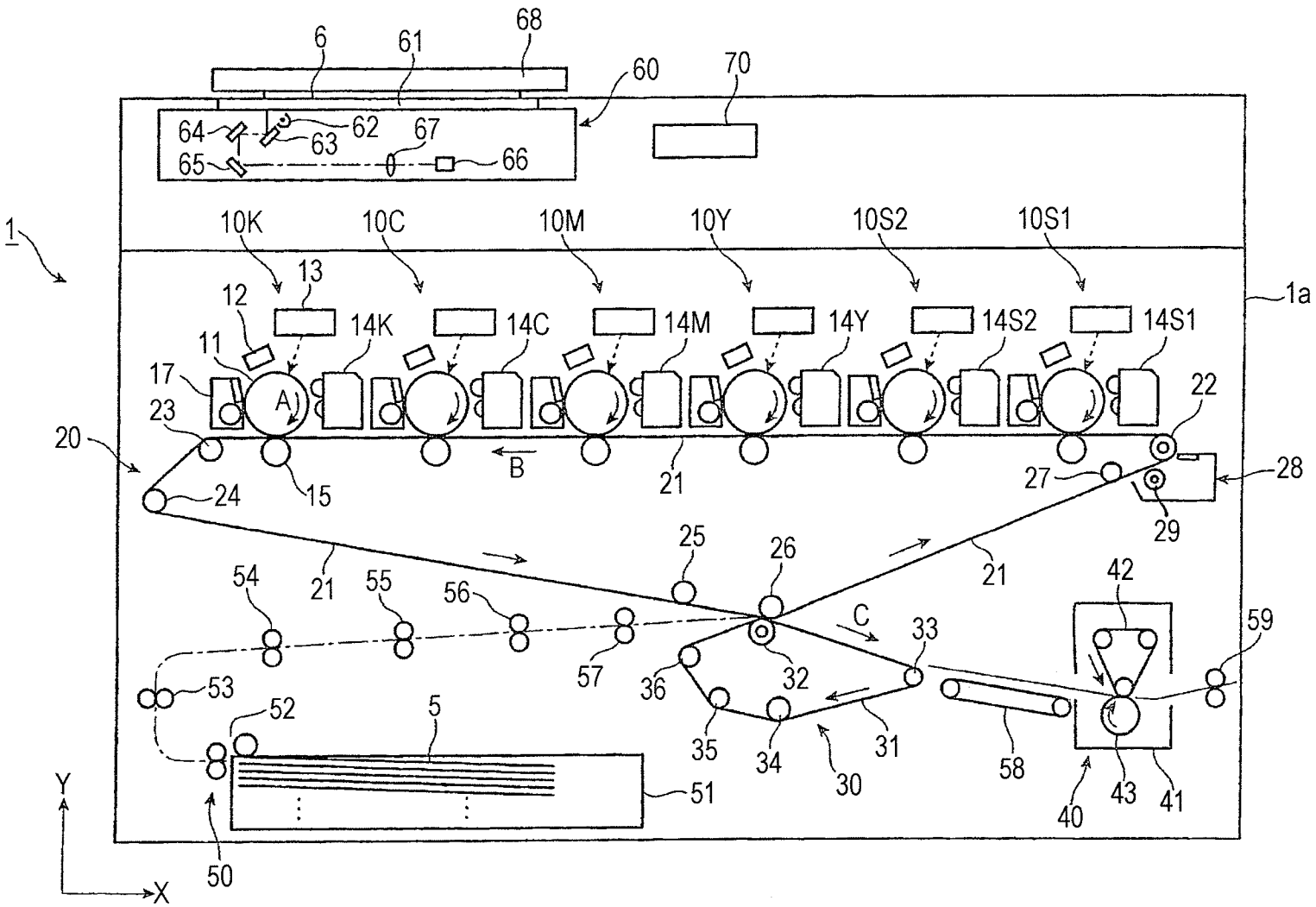
FIG. 1 illustrates the structure of an image forming apparatus according to a first exemplary embodiment of the present invention.
Figure 2:
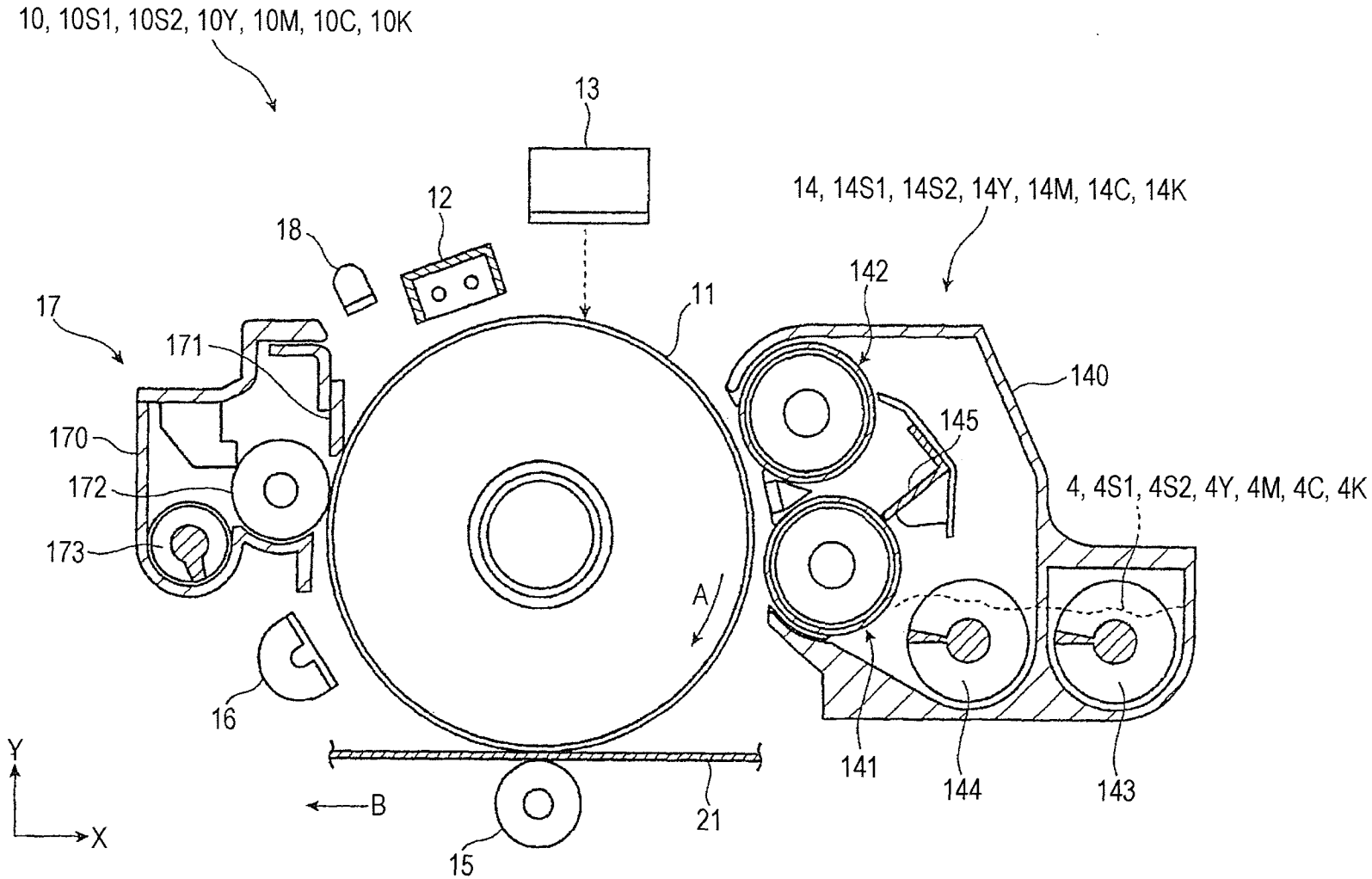
FIG. 2 illustrates the structure of a part of the image forming apparatus according to the first exemplary embodiment of the present invention.

FIGS. 1 and 2 illustrate an image forming apparatus 1 according to the first exemplary embodiment. FIG. 1 illustrates the overall structure of the image forming apparatus 1, and FIG. 2 illustrates an enlarged view of a part (for example, image forming devices) of the image forming apparatus 1.

Overall Structure of Image Forming Apparatus

The image forming apparatus 1 according to the first exemplary embodiment is, for example, a color printer. The image forming apparatus 1 includes plural image forming devices 10, an intermediate transfer device 20, a paper feeding device 50, and a fixing device 40. Each image forming device 10 forms a toner image developed with toner contained in developer 4. The intermediate transfer device 20 carries toner images formed by the respective image forming devices 10 and transports the toner images to a second transfer position at which the toner images are transferred onto a sheet of recording paper 5, which is an example of a recording medium, in a second transfer process. The paper feeding device 50 contains and transports the sheet of recording paper 5 to be supplied to the second transfer position of the intermediate transfer device 20. The fixing device 40 fixes the toner images that have been transferred onto the sheet of recording paper 5 by the intermediate transfer device 20 in the second transfer process.

In the case where, for example, an image input device 60 that inputs a document image to be formed on the sheet of recording paper 5 is additionally provided, the image forming apparatus 1 may be configured as a color copier. Referring to FIG. 1, the image forming apparatus 1 includes a housing 1*a* including, for example, a supporting structural member and an external covering part. The one-dot chain line shows a transport path along which the sheet of recording paper 5 is transported in the housing 1*a*. Structure of Part of Image Forming Apparatus The image forming devices 10 include six image forming devices 10Y, 10M, 10C, 10K, 10S1, and 10S2. The image forming devices 10Y, 10M, 10C, and 10K respectively form toner images of four colors, which are yellow (Y), magenta (M), cyan (C), and black (K). The image forming devices 10S1 and 10S2 respectively form two types of toner images of special colors S1 and S2. The six image forming devices 10 (S1, S2, Y, M, C, and K) are arranged along a line in the inner space of the housing 1*a*. The developers 4 (S1 and S2) of the special colors (S1 and S2) contain, for example, materials of colors which are difficult or impossible to be expressed by the above-described four colors. More specifically, toners of colors other than the four colors, toners having the same colors as the four colors but saturations different from those of the toners of four colors, clear toners that increase the glossiness, foaming toners used in Braille printing, fluorescent toners, etc., may be used. The image forming devices 10 (S1, S2, Y, M, C, and K) have a substantially similar structure, as described below, except for the type of the developer used therein.

As illustrated in FIGS. 1 and 2, each image forming device 10 (S1, S2, Y, M, C, or K) includes a photoconductor drum 11 that rotates, and devices described below are arranged around the photoconductor drum 11. The devices include a charging device 12, an exposure device 13, a developing device 14 (S1, S2, Y, M, C, K), a first transfer device 15, a pre-cleaning charging device 16, a drum cleaning device 17, and a electricity removing device 18. The charging device 12 charges a peripheral surface (image carrying surface) of the photoconductor drum 11, on which an image may be formed, to a certain potential. The exposure device 13 irradiates the charged peripheral surface of the photoconductor drum 11 with light LB based on image information (signal) to form an electrostatic latent image (for the corresponding color) having a potential difference. The developing device 14 (S1, S2, Y, M, C, or K) forms a toner image by developing the electrostatic latent image with toner contained in the developer 4 of the corresponding color (S1, S2, Y, M, C, or K). The first transfer device 15 performs a first transfer process in which the toner image is transferred onto the intermediate transfer device 20. The pre-cleaning charging device 16 charges substances, such as toner, that remain on the image carrying surface of the photoconductor drum 11 after the first transfer process. The drum cleaning device 17 cleans the image carrying surface by removing the recharged substances. The electricity removing device 18 removes electricity from the image carrying surface of the photoconductor drum 11 after the cleaning process.

The photoconductor drum 11 includes a cylindrical or columnar base member that is grounded and a photoconductive layer (photosensitive layer) that is provided on the peripheral surface of the base member. The photoconductive layer is made of a photosensitive material and is provided with the image carrying surface. The photoconductor drum 11 is supported so as to be capable of rotating in the direction shown by arrow A when power is transmitted thereto from a rotation driving device (not shown).

The charging device 12 is a non-contact charging device, such as a corona discharger, and is arranged without contacting the photoconductor drum 11. The charging device 12 includes a discharge member that receives a charging voltage. In the case where the developing device 14 performs reversal development, a voltage or current having the same polarity as the charging polarity of the toner supplied by the developing device 14 is supplied as the charging voltage.

The exposure device 13 forms the electrostatic latent image by irradiating the charged peripheral surface of the photoconductor drum 11 with light (arrowed dashed line) LB generated in accordance with the image information input to the image forming apparatus 1. When forming the electrostatic latent image, the exposure device 13 receives the image information (signal) that is input to the image forming apparatus 1 by any method.

As illustrated in FIG. 2, each developing device 14 (S1, S2, Y, M, C, or K) includes a housing 140 having an opening and a chamber of the developer 4. Two developing rollers 141 and 142, two stirring-and-transporting members 143 and 144, and a layer-thickness regulating member 145 are disposed in the housing 140. The two developing rollers 141 and 142 hold the developer 4 and transport the developer 4 to respective developing areas in which the developing rollers 141 and 142 face the photoconductor drum 11. The stirring-and-transporting members 143 and 144 are, for example, two screw augers that transport the developer 4 while stirring the developer 4 so that the developer 4 is moved along the developing roller 141. The layer-thickness regulating member 145 regulates the amount (layer thickness) of the developer 4 held by the developing roller 141. A developing voltage supplied from a power supply device (not shown) is applied between the photoconductor drum 11 and the developing rollers 141 and 142 of the developing device 14. The developing rollers 141 and 142 and the stirring-and-transporting members 143 and 144 receive power from a rotation driving device (not shown) and rotates in a certain direction. Two-component developers containing nonmagnetic toner and magnetic carrier are used as the developers 4 (Y, M, C, and K) of the above-described four colors and the developers 4 (S1 and S2) of the two special colors.

The first transfer device 15 is a contact transfer device including a first transfer roller which rotates while contacting the peripheral surface of the photoconductor drum 11 and receives a first transfer voltage. A direct-current voltage having a polarity opposite to the charging polarity of the toner is supplied as the first transfer voltage from the power supply device (not shown).

As illustrated in FIG. 2, the drum cleaning device 17 includes a container-shaped body 170 that has an opening, a cleaning plate 171, a rotating brush roller 172, and a transporting member 173. The cleaning plate 171 is arranged to contact the peripheral surface of the photoconductor drum 11 at a certain pressure after the first transfer process and clean the peripheral surface of the photoconductor drum 11 by removing substances such as residual toner therefrom. The rotating brush roller 172 is arranged to contact with the peripheral surface of the photoconductor drum 11 while rotating at a position upstream of the cleaning plate 171 in the rotation direction of the photoconductor drum 11. The transporting member 173 is, for example, a screw auger that transports the substances such as toner that have been removed by the cleaning plate 171 to a collecting system (not shown). The cleaning plate 171 may be formed of a plate-shaped member (for example, a blade) made of rubber or the like.

As illustrated in FIG. 1, the intermediate transfer device 20 is disposed below the image forming devices 10 (S1, S2, Y, M, C, and K). The intermediate transfer device 20 basically includes an intermediate transfer belt 21, plural belt support rollers 22 to 27, a second transfer device 30, and a belt cleaning device 28. The intermediate transfer belt 21 rotates in the direction shown by arrow B while passing through a first transfer position, which is between the photoconductor drum 11 and the first transfer device 15 (first transfer roller). The belt support rollers 22 to 27 retain the intermediate transfer belt 21 in a desired position at the inner surface of the intermediate transfer belt 21 so that the intermediate transfer belt 21 is rotatably supported. The second transfer device 30 is disposed to oppose the belt support roller 26 that supports the intermediate transfer belt 21 at the outer-peripheral-surface (image-carrying-surface) side of the intermediate transfer belt 21. The second transfer device 30 performs a second transfer process in which the toner images on the intermediate transfer belt 21 are transferred onto the sheet of recording paper 5. The belt cleaning device 28 cleans the outer peripheral surface of the intermediate transfer belt 21 by removing substances such as toner and paper dust that remain on the outer peripheral surface of the intermediate transfer belt 21 after the intermediate transfer belt 21 has passed the second transfer device 30.

The intermediate transfer belt 21 may be, for example, an endless belt made of a material obtained by dispersing a resistance adjusting agent, such as carbon black, in a synthetic resin, such as polyimide resin or polyamide resin. The belt support roller 22 serves as a driving roller. The belt support rollers 23, 25, and 27 serve as driven rollers for retaining the position of the intermediate transfer belt 21. The belt support roller 24 serves as a tension-applying roller. The belt support roller 26 serves as a back-up roller in the second transfer process.

As illustrated in FIG. 1, the second transfer device 30 includes a second transfer belt 31 and plural support rollers 32 to 36. The second transfer belt 31 rotates in the direction shown by arrow C while passing through a second transfer position, which is on the outer-peripheral-surface side of the intermediate transfer belt 21 that is supported by the belt support roller 26 in the intermediate transfer device 20. The support rollers 32 to 36 retain the second transfer belt 31 in a desired position at the inner surface of the second transfer belt 31 so that the second transfer belt 31 is rotatably supported. The second transfer belt 31 is, for example, an endless belt having substantially the same structure as that of the above-described intermediate transfer belt 21. The belt support roller 32 is arranged so that the second transfer belt 31 is pressed at a certain pressure against the outer peripheral surface of the intermediate transfer belt 21 supported by the belt support roller 26. The belt support roller 32 serves as a driving roller, and the belt support roller 36 serves as a tension-applying roller. The belt support roller 32 of the second transfer device 30 or the belt support roller 26 of the intermediate transfer device 20 receives a direct-current voltage having a polarity that is opposite to or the same as the charging polarity of the toner as a second transfer voltage.

The fixing device 40 includes a heating rotating body 42 and a pressing rotating body 43 that are arranged in a housing 41 having an inlet and an outlet for the sheet of recording paper 5. The heating rotating body 42 includes a fixing belt that rotates in the direction shown by the arrow and that is heated by a heater so that the surface temperature thereof is maintained at a predetermined temperature. The pressing rotating body 43 is drum-shaped and contacts the heating rotating body 42 at a certain pressure substantially along the axial direction of the heating rotating body 42, so that the pressing rotating body 43 is rotated. In the fixing device 40, the contact portion in which the heating rotating body 42 and the pressing rotating body 43 contact each other serves as a fixing process unit that performs a certain fixing process (heating and pressing).

The paper feeding device 50 is disposed below the intermediate transfer device 20 and the second transfer device 30. The paper feeding device 50 basically includes at least one paper container 51 that contains sheets of recording paper 5 of the desired size, type, etc., in a stacked manner and a transporting device 52 that feeds the sheets of recording paper 5 one at a time from the paper container 51. The paper container 51 is, for example, attached to the housing 1*a* such that the paper container 51 may be pulled out therefrom at the front side (side that faces the user during operation) of the housing 1*a*.

Plural pairs of paper transport rollers 53 to 57, which transport each of the sheets of recording paper 5 fed from the paper feeding device 50 to the second transfer position, and a paper transport path including transport guide members (not shown) are provided between the paper feeding device 50 and the second transfer device 30. The pair of paper transport rollers 57 that are disposed immediately in front of the second transfer position on the paper transport path serve as, for example, registration rollers for adjusting the time at which each sheet of recording paper 5 is to be transported. A paper transport device 58, which may be belt-shaped, is provided between the second transfer device 30 and the fixing device 40. The paper transport device 58 transports the sheet of recording paper 5 that has been transported from the second transfer belt 31 of the second transfer device 30 after the second transfer process to the fixing device 40. A pair of paper discharge rollers 59 are disposed near a paper outlet formed in the housing 1*a*. The pair of paper discharge rollers 59 discharge the sheet of recording paper 5 that has been subjected to the fixing process and transported from the fixing device 40 to the outside of the housing 1*a*.

The image input device 60, which is provided when the image forming apparatus 1 is formed as a color copier, is an image reading device that reads an image of a document 6 having the image information to be printed. The image input device 60 is arranged, for example, above the housing 1*a* as illustrated in FIG. 1. The image input device 60 basically includes a document receiving plate (platen glass) 61, a light source 62, a reflection mirror 63, a first reflection mirror 64, a second reflection mirror 65, an image reading element 66, and an imaging lens 67. The document receiving plate 61 includes, for example, a transparent glass plate on which the document 6 having the image information to be read is placed. The light source 62 irradiates the document 6 placed on the document receiving plate 61 while moving. The reflection mirror 63 receives reflected light from the document 6 and reflects the light in a predetermined direction while moving together with the light source 62. The first and second reflection mirrors 64 and 65 move at a predetermined speed by a predetermined distance with respect to the reflection mirror 63. The image reading element 66 includes, for example, a charge coupled device (CCD) that receives and reads the reflected light from the document 6 and converts the reflected light into an electrical signal. The imaging lens 67 focuses the reflected light on the image reading element 66. Referring to FIG. 1, the document receiving plate 61 is covered by an opening-closing covering part 68.

The image information of the document 6 that has been read by the image input device 60 is input to an image processing device 70, which subjects the image information to necessary image processing. The image input device 60 transmits the read image information of the document 6 to the image processing device 70 as, for example, red (R), green (G), and blue (B) three-color image data (for example, 8-bit data for each color). The image processing device 70 subjects the image data transmitted from the image input device 60 to predetermined image processing, such as shading correction, misregistration correction, brightness/color space conversion, gamma correction, frame erasing, and color/movement edition. The image processing device 70 converts the image signals obtained as a result of the image processing into image signals of the above-described four colors (Y, M, C, and K), and transmits the image signals to the exposure device 13. The image processing device 70 also generates image signals for the two special colors (S1 and S2).

Operation of Image Forming Apparatus

A basic image forming operation performed by the image forming apparatus 1 will now be described.

First, an image forming operation for forming a full-color image by combining toner images of four colors (Y, M, C, and K) by using the four image forming devices 10 (Y, M, C, and K) will be described.

When the image forming apparatus 1 receives command information of a request for the image forming operation (printing), the four image forming devices 10 (Y, M, C, and K), the intermediate transfer device 20, the second transfer device 30, and the fixing device 40 are activated.

In each of the image forming devices 10 (Y, M, C, and K), first, the photoconductor drum 11 rotates in the direction shown by arrow A and the charging device 12 charges the surface of the photoconductor drum 11 to a certain potential with a certain polarity (negative polarity in the first exemplary embodiment). Subsequently, the exposure device 13 irradiates the charged surface of the photoconductor drum 11 with the light LB based on the image signal obtained by converting the image information input to the image forming apparatus 1 into a component of the corresponding color (Y, M, C, or K). As a result, an electrostatic latent image for the corresponding color having a certain potential difference is formed on the surface of the photoconductor drum 11.

After that, each of the developing devices 14 (Y, M, C, and K) supplies the toner of the corresponding color (Y, M, C, or K), charged with a certain polarity (negative polarity), from the developing rollers 141 and 142 to the electrostatic latent image of the corresponding color formed on the photoconductor drum 11. The toner electrostatically adheres to the electrostatic latent image, so that the electrostatic latent image is developed. As a result of the developing process, the electrostatic latent images for the respective colors formed on the photoconductor drums 11 are visualized as toner images of the four colors (Y, M, C, and K) developed with the toners of the respective colors.

When the toner images of the respective colors formed on the photoconductor drums 11 of the image forming devices 10 (Y, M, C, and K) reach the respective first transfer positions, the first transfer devices 15 perform the first transfer process so that the toner images of the respective colors are successively transferred, in a superimposed manner, onto the intermediate transfer belt 21 of the intermediate transfer device 20 that rotates in the direction of arrow B.

In each image forming device 10, after the first transfer process, the pre-cleaning charging device 16 recharges the substances, such as toner, that remain on the surface of the photoconductor drum 11 after the first transfer process. Subsequently, the drum cleaning device 17 cleans the surface of the photoconductor drum 11 by scraping off the recharged substances, and the electricity removing device 18 removes the electricity from the cleaned surface of the photoconductor drum 11. Thus, the image forming device 10 is set to a standby state for the next image forming process.

In the intermediate transfer device 20, the intermediate transfer belt 21 rotates so as to transport the toner images that have been transferred onto the intermediate transfer belt 21 by the first transfer process to the second transfer position. The paper feeding device 50 feeds a sheet of recording paper 5 to the paper transport path in accordance with the image forming process. In the paper transport path, the pair of paper transport rollers 57, which serve as registration rollers, transport the sheet of recording paper 5 to the second transfer position in accordance with the transfer timing.

At the second transfer position, the second transfer device 30 performs the second transfer process in which the toner images on the intermediate transfer belt 21 are simultaneously transferred onto the sheet of recording paper 5. In the intermediate transfer device 20 after the second transfer process, the belt cleaning device 28 cleans the surface of the intermediate transfer belt 21 by removing the substances, such as toner, that remain on the surface after the second transfer process.

The sheet of recording paper 5, onto which the toner images have been transferred by the second transfer process, is released from the intermediate transfer belt 21 and from the second transfer belt 31 and transported to the fixing device 40 by the paper transport device 58. In the fixing device 40, the sheet of recording paper 5 after the second transfer process is guided through the contact portion between the heating rotating body 42 and the pressing rotating body 43 that rotate. Thus, a fixing process (heating and pressing) is performed so that the unfixed toner images are fixed to the sheet of recording paper 5. In the case where the image forming operation is performed to form an image only on one side of the sheet of recording paper 5, the sheet of recording paper 5 that has been subjected to the fixing process is discharged to, for example, a discharge container (not illustrated) disposed outside the housing 1*a* by the paper discharge rollers 59.

As a result of the above-described operation, the sheet of recording paper 5 on which a full-color image is formed by combining toner images of four colors is output.

Next, the case will be described in which special-color toner images are additionally formed by using the developers of the special colors S1 and S2 in the above-described normal image forming operation performed by the image forming apparatus 1.

In this case, first, the image forming devices 10S1 and 10S2 perform an operation similar to the image forming process performed by the image forming devices 10 (Y, M, C, and K). Accordingly, special-color toner images (S1 and S2) are formed on the photoconductor drums 11 of the image forming devices 10S1 and 10S2. Subsequently, similar to the manner in which the toner images of the four colors are processed in the above-described image forming operation, the special-color toner images formed by the image forming devices 10S1 and 10S2 are transferred onto the intermediate transfer belt 21 of the intermediate transfer device 20 in the first transfer process. Then, in the second transfer process, the second transfer device 30 transfers the special-color toner images from the intermediate transfer belt 21 onto the sheet of recording paper 5 together with the toner images of the other colors. Lastly, the sheet of recording paper 5, onto which the special-color toner images and the toner images of the other colors have been transferred in the second transfer process, is subjected to the fixing process performed by the fixing device 40 and discharged to the outside of the housing 1*a*.

As a result of the above-described operation, the sheet of recording paper 5 is output on which the two special-color toner images overlap with a part or the entirety of the full-color image formed by combining the toner images of four colors together.

In the case where the image forming apparatus 1 is equipped with the image input device 60 and serves as a color copier, a basic image forming operation is performed as follows.

That is, in this case, when the document 6 is set to the image input device 60 and command information of a request for the image forming operation (copying) is input, the image input device 60 reads the document image from the document 6. The information of the read document image is subjected to the above-described image processing performed by the image processing device 70, so that the image signals are generated. The image signals are transmitted to the exposure devices 13 of the image forming devices 10 (S1, S2, Y, M, C, and K). Accordingly, each image forming device 10 forms an electrostatic latent image and a toner image based on the image information of the document 6. After that, an operation similar to the above-described image forming operation (printing) is performed and the sheet of recording paper 5 on which an image obtained by combining the toner images together is formed is output.

Toner Used in Image Forming Device

In the present exemplary embodiment, yellow (Y), magenta (M), cyan (C), and black (K) image forming devices 10 (Y, M, C, and K) use toners having relatively small particle diameters (number-average particle diameters), e.g., about 5 to 6 μm, to comply with high image quality requirements. The image forming devices 10S1 and 10S2 that form toner images of special colors S1 and S2 use, for example, clear toners or foaming toners for Braille printing. The clear toners and foaming toners for Braille printing have relatively large particle diameters (number-average particle diameters) which are, for example, about 10 to 40 μm. In the present exemplary embodiment, it is assumed that the image forming device 10S1 uses a clear toner and the image forming device 10S2 uses a foaming toner for Braille printing.

Structure of Collected-Toner Transporting Device

Figure 3:
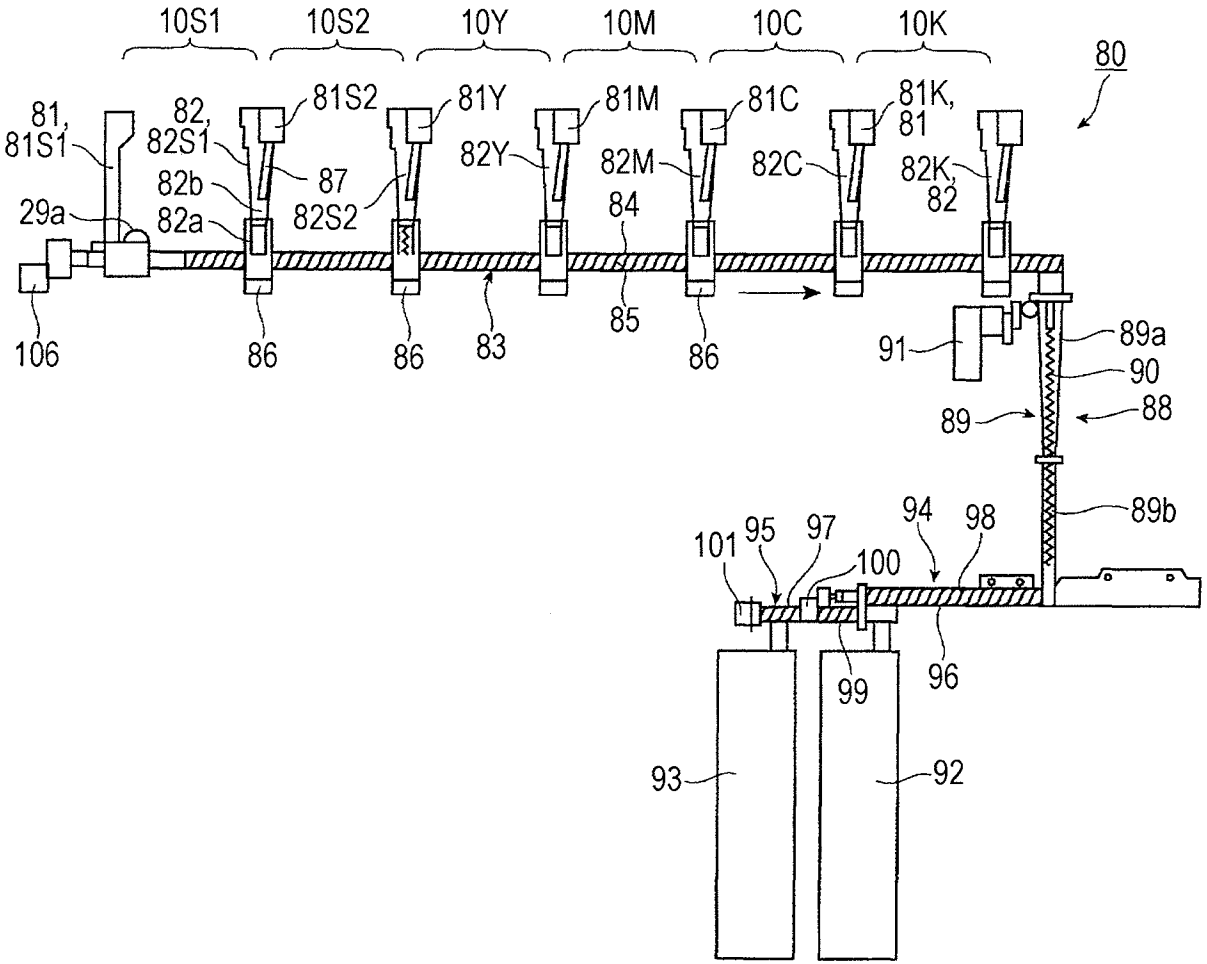
FIG. 3 illustrates the structure of a collected-toner transporting device.

FIG. 3 illustrates the structure of a collected-toner transporting device 80 included in the image forming apparatus. The collected-toner transporting device 80 is disposed on the back side of the housing 1*a* of the image forming apparatus 1, and FIG. 3 is a rear view of the image forming apparatus.

Each of the image forming devices 10 (S1, S2, Y, M, C, and K) includes a developer collector 81 that receives excess developer discharged from the developing device 14 and a toner collector 82 that receives substances such as residual toner discharged from the drum cleaning device 17. A collecting transport member (not shown) is provided at an end of one of the stirring-and-transporting members 143 and 144 of the developing device 14. The collecting transport member extends to the back side of the image forming apparatus 1 and collects the excess developer in the developer collector 81. The transporting member 173, such as a screw auger, of the cleaning device 17 extends to the back side of the image forming apparatus 1 and collects the substances such as the collected toner in the toner collector 82.

A horizontal transport unit 83, which forms a transport path of the collected-toner transporting device 80, extends below the developer collectors 81 and the toner collectors 82 of the image forming devices 10 (S1, S2, Y, M, C, and K) from the position below the special-color (S1) developer collector 81S1 to the position below the black (K) toner collector 82K. The horizontal transport unit 83 includes at least a passage forming member 84 having a cylindrical inner structure and a transporting member 85, such as a screw auger, that extends through the passage forming member 84 over the entire length of the passage forming member 84. The transporting member 85 is rotated through a gear (not shown) by a drive motor 106 provided at an end of the transporting member 85 near the special-color (S1) developer collector 81S1. The transporting direction of the transporting member 85 is set so that the special-color (S1) developer collector 81S1 is located at the upstream side and the black (K) toner collector 82K is located at the downstream side.

The passage forming member 84 is connected to the bottom ends of the developer collectors 81 and the toner collectors 82, and the excess developers collected by the developer collectors 81 and the substances such as residual toners collected by the toner collectors 82 are introduced into the passage forming member 84. The passage forming member 84 includes support members 86 at positions corresponding to the toner collectors 82. The support members 86 support cylindrical bottom end portions 82*a* of the toner collectors 82. The toner collectors 82 include cylindrical portions 82*b* in which helical agitators or the like that assist downward movement of the toners may be disposed.

The developer collectors 81 include tubular members 87 that are connected to the cylindrical portions 82*b* of the toner collectors 82 at intermediate positions of the cylindrical portions 82*b*, and the developers are collected through the toner collectors 82.

Figure 4:
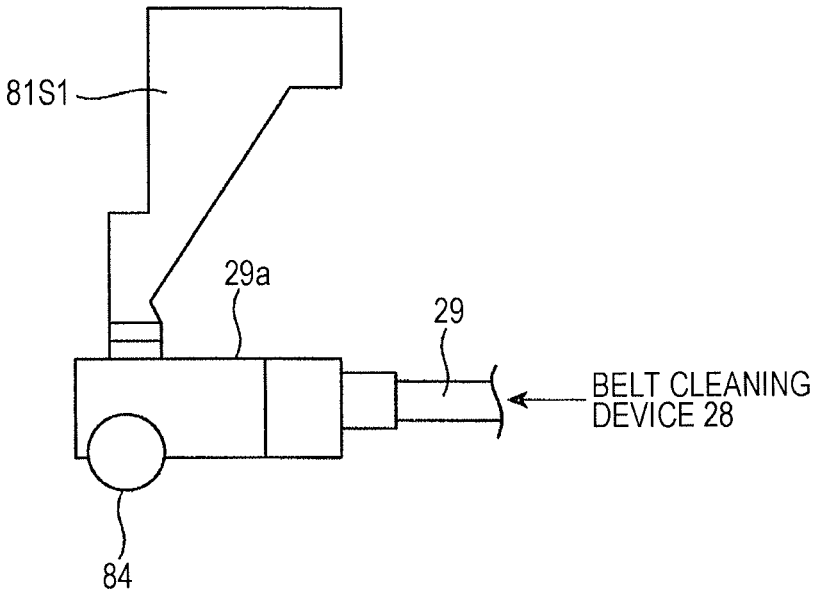
FIG. 4 illustrates the structure of a part of the collected-toner transporting device.

As illustrated in FIG. 4, the special-color (S1) developer collector 81S1 is connected to the passage forming member 84 at a position adjacent to an end 29*a* of a transporting member 29, such as a screw auger, that transports substances such as residual toners collected by the belt cleaning device 28 of the intermediate transfer belt 21 toward the back side of the housing 1*a* of the image forming apparatus 1.

As illustrated in FIG. 3, the downstream end of the horizontal transport unit 83 in the transporting direction is connected to a dropping transport unit 88 through which the collected substances transported by the horizontal transport unit 83 are caused to fall in the direction of gravity. The dropping transport unit 88 includes a cylindrical passage forming member 89 and a transporting member 90, such as a helical agitator, disposed in the passage forming member 89. The transporting member 90 is rotated by a drive motor 91. The passage forming member 89 includes an upper portion 89*a* that is tapered such that the diameter thereof decreases toward the bottom and a lower portion 89*b* having a cylindrical shape with a uniform diameter.

The bottom end of the dropping transport unit 88 is connected to a final transport unit that transports the collected substances transported by the dropping transport unit 88 to large-capacity containers 92 and 93 that are arranged next to each other. The final transport unit includes a first transport unit 94 and a second transport unit 95. Among the two containers 92 and 93 that are arranged next to each other, the first transport unit 94 transports the collected substances to the upstream container 92 and the second transport unit 95 transports the collected substances that have been transported to the upstream container 92 by the first transport unit 94 to the downstream container 93. The first and second transport units 94 and 95 respectively include at least passage forming members 96 and 97 having cylindrical inner structures and transporting members 98 and 99, such as screw augers, that extend through the passage forming members 96 and 97. The transporting members 98 and 99 are respectively rotated by drive motors 100 and 101. When the container 92 becomes full, the collected substances are transported to the other container 93 by the first and second transport units 94 and 95.

Operation of Collected-Toner Transporting Device

At a predetermined operation time, such as when the image forming operation is completed or when a predetermined number of sheets have been subjected to printing, the horizontal transport unit 83, the dropping transport unit 88, and the final transport unit of the collected-toner transporting device 80 are activated. Accordingly, the collected substances including the excess developers collected by the developer collectors 81 and substances such as residual toners collected by the toner collectors 82 are transported through the horizontal transport unit 83, the dropping transport unit 88, and the final transport unit and collected in the container 92 or 93.

The special-color (S1) image forming device 10S1, which uses a toner having a relatively large particle diameter, is located at a most upstream position along the horizontal transport unit 83, and the special-color (S2) image forming device 10S2, which also uses a toner having a relatively large particle diameter, is located on the downstream side of the special-color (S1) image forming device 10S1.

When the collected-toner transporting device 80 is activated, in the yellow (Y), magenta (M), cyan (C), and black (K) image forming devices 10 (Y, M, C, and K), which use toners having relatively small particle diameters, the toners easily adhere to wall surfaces of the passage forming members 84, 89, 96, and 97 and the transporting members 85, 90, 98, and 99 included in the horizontal transport unit 83, the dropping transport unit 88, and the final transport unit owing to the small diameters thereof. Therefore, there is a risk that clogging will occur.

In the present exemplary embodiment, the developer collectors 81 and the toner collectors 82 that collect the substances from the special-color (S1) and special-color (S2) image forming devices 10S1 and 10S2, which use the toners having relatively large particle diameters, are arranged in an upstream region of the horizontal transport unit 83. Therefore, the toners having relatively large particle diameters are collected through the developer collectors 81 and the toner collectors 82 arranged in the upstream region of the horizontal transport unit 83, and are transported through the passage forming members. The toners having relatively large particle diameters have relatively large volumes, and do not easily adhere to the transporting members. The toners having relatively large particle diameters are transported while receiving a transporting force applied by the transporting members, and are therefore capable of removing the toners having relatively small particle diameters that have adhered to the wall surfaces of the passage forming members and the transporting members. As a result, the occurrence of toner clogging at the passage forming members and the transporting members in the horizontal transport unit 83, the dropping transport unit 88, and the final transport unit may be reduced.

Second Exemplary Embodiment

Figure 5:
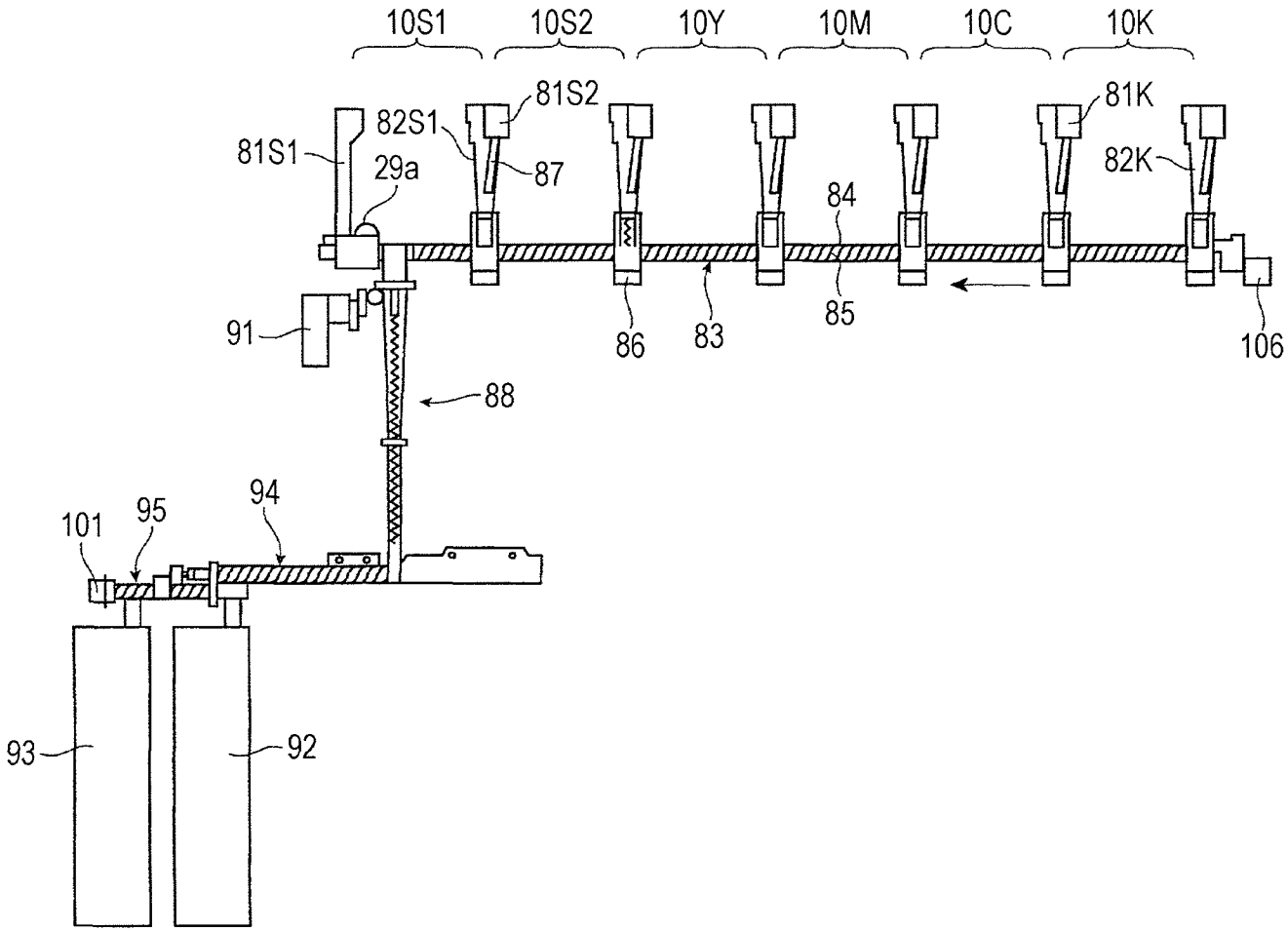
FIG. 5 illustrates the structure of a collected-toner transporting device included in an image forming apparatus according to a second exemplary embodiment of the present invention.

FIG. 5 illustrates an image forming apparatus according to a second exemplary embodiment of the present invention. Components similar to those in the above-described first exemplary embodiment are denoted by the same reference numerals. In the second exemplary embodiment, a toner having a relatively large particle diameter is used in an image forming device positioned at an end of a horizontal transport unit, and a transport path of a collected-toner transporting device is set so that the image forming device that uses the toner having a relatively large particle diameter is at an upstream position in a toner collecting direction.

Specifically, in the second exemplary embodiment, a black (K) image forming device 10K, which is disposed at the right end in FIG. 5, uses black (K) toner having a relatively large particle diameter. The black (K) toner has a relatively large particle diameter (number-average particle diameter) which are, for example, about 10 to 20 μm.

Special-color (S1) and special-color (S2) image forming devices 10S1 and 10S2, for example, use toners having the same colors as magenta (M) and cyan (C) toners but having saturations different from those of the magenta (M) and cyan (C) toners. To increase the image quality, the toners having the same colors as the magenta (M) and cyan (C) toners but having saturations different from those of the magenta (M) and cyan (C) toners have relatively small particle diameters, similar to the magenta (M) and cyan (C) toners.

Structure of Collected-Toner Transporting Device

FIG. 5 illustrates the structure of a collected-toner transporting device 80 included in the image forming apparatus according to the second exemplary embodiment.

A horizontal transport unit 83 is configured such that a transporting member 85 disposed in a passage forming member 84 transports collected substances, such as residual toners, so that the black (K) image forming device 10K is at the most upstream position and the special-color (S1) image forming device 10S1 is at a downstream position. The transporting member 85 is rotated by a drive motor 106 arranged at an end of the transporting member 85 near the black (K) image forming device 10K.

In the present exemplary embodiment, a dropping transport unit 88 is disposed between a developer collector 81S1 and a toner collector 82S1 of the special-color (S1) image forming device 10S1. The excess developer from the developer collector 81S1 of the special-color (S1) image forming device 10S1 is transported to the dropping transport unit 88 in the same direction as that in the first exemplary embodiment.

Thus, also in the second exemplary embodiment, the toner collector 82K that collects the toner having a relatively large particle diameter is disposed at an upstream position. Therefore, similar to the first exemplary embodiment, the occurrence of toner clogging at the passage forming members and the transporting members in the horizontal transport unit 83, the dropping transport unit 88, and the final transport unit may be reduced.

Other structures and operations are similar to those in the first exemplary embodiment, and explanations thereof are thus omitted.

Third Exemplary Embodiment

Figure 6:
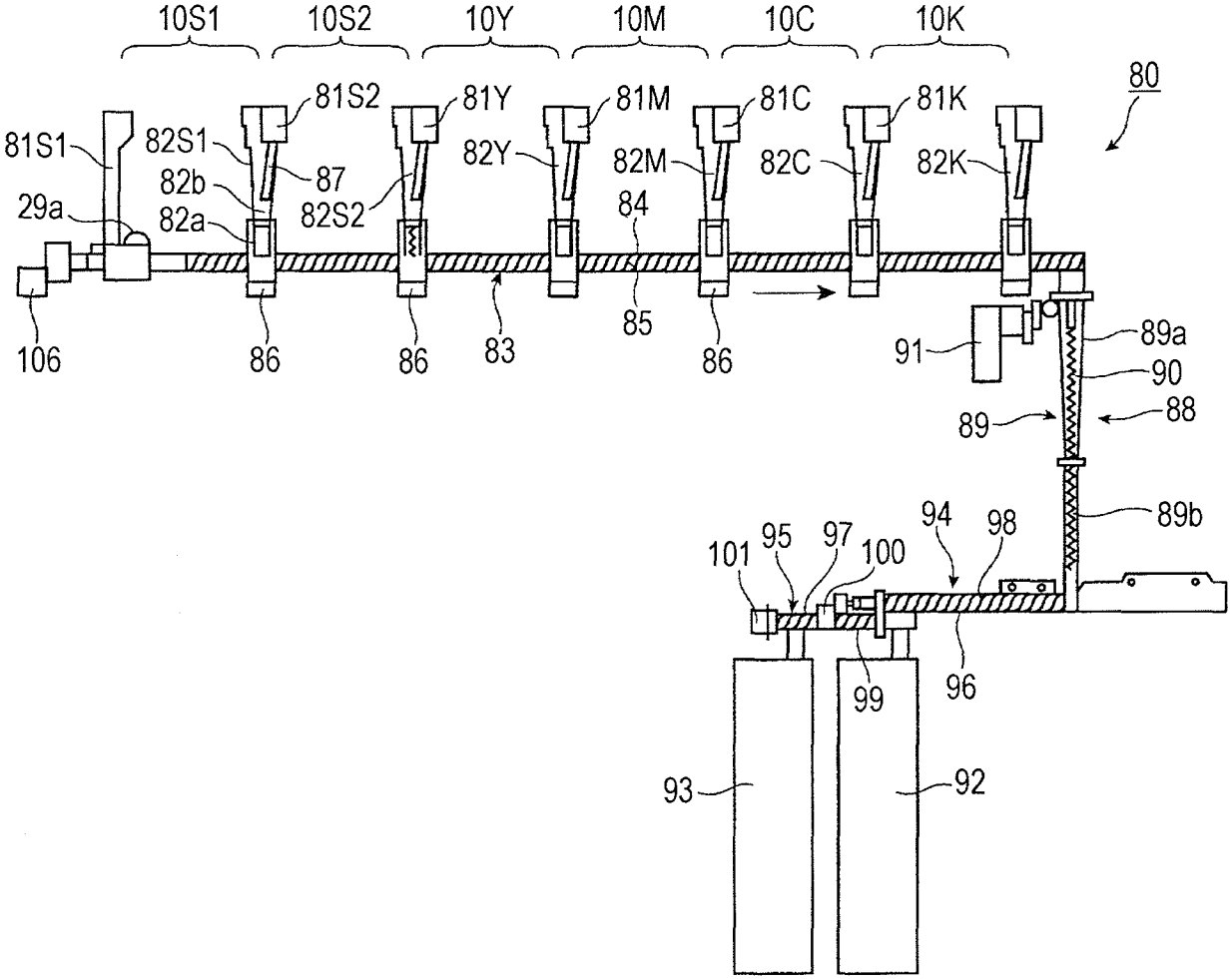
FIG. 6 illustrates the structure of a collected-toner transporting device included in an image forming apparatus according to a third exemplary embodiment of the present invention.

FIG. 6 illustrates an image forming apparatus according to a third exemplary embodiment of the present invention. Components similar to those in the above-described exemplary embodiments are denoted by the same reference numerals. In the third exemplary embodiment, a cleaning mode for cleaning a transport path of a transporting device is provided. In the cleaning mode, a toner image to be collected is formed by using a toner having a relatively large particle diameter, and is collected by a toner collecting unit located at an upstream position in the transporting direction of the collected toners.

In the third exemplary embodiment, as illustrated in FIG. 6, among special-color (S1), special-color (S2), yellow (Y), magenta (M), cyan (C), and black (K) image forming devices 10 (S1, S2, Y, M, C, and K) arranged along a line, the image forming device 10K that uses a black (K) toner, which has a relatively large particle diameter, is disposed at the most downstream position of a horizontal transport unit 83 of a collected-toner transporting device 80 in the toner collecting direction. The special-color (S1) and special-color (S2) image forming devices 10S1 and 10S2 use toners having relatively small particle diameters.

In the present exemplary embodiment, the collected-toner transporting device 80 has a cleaning mode for cleaning the transport path of, for example, the horizontal transport unit 83. In the cleaning mode, a toner band formed of a band-shaped tone image is formed on the photoconductor drum 11 by the image forming device 10K that uses the black (K) toner, which has a relatively large particle diameter. The toner band formed on the photoconductor drum 11 is transferred onto the intermediate transfer belt 21. Then, the polarity of the second transfer unit is switched so that the toner band passes through the second transfer unit and is collected by the belt cleaning device 28 that removes the substances such as toners from the intermediate transfer belt 21.

The toners collected by the belt cleaning device 28 is guided into a passage forming member 84 included in the horizontal transport unit 83 at a position downstream of a developer collector 81 of the special-color (S1) image forming device 10S1, which is located at the most upstream position, as illustrated in FIGS. 4 and 6.

Thus, in the third exemplary embodiment, the black (K) toner, which has a relatively large particle diameter, may be transported from the upstream region of the horizontal transport unit 83 in the cleaning mode. As a result, clogging of the passage forming member 84 may be suppressed owing to the black (K) toner, which has a relatively large particle diameter, collected from the upstream region of the passage forming member 84 of the horizontal transport unit 83.

Other structures and operations are similar to those in the first exemplary embodiment, and explanations thereof are thus omitted.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a first image forming unit configured to form an image by using a first toner having a first average particle diameter;

a second image forming unit configured to form an image by using a second toner having a second average particle diameter that is greater than the first average particle diameter; and a transport path configured to transport the residual first toner and residual second toner collected from the first and second image forming units, respectively, wherein the transport path is configured such that a position at which the residual second toner is collected from the second image forming unit is located upstream of a position at which the residual first toner is collected from the first image forming unit in a transporting direction of the transport path.

2. The image forming apparatus according to claim 1, wherein the residual first toner comprises excess waste toner leftover from forming the image by the first image forming unit, and wherein the residual second toner comprises excess waste toner leftover from forming the image by the second image forming unit.

3. The image forming apparatus according to claim 1, wherein the first image forming unit comprises:

a first drum cleaning device; and a first toner collector configured to collect the residual first toner discharged from the first drum cleaning device, wherein the second image forming unit comprises:

a second drum cleaning device; and a second toner collector configured to collect the residual second toner discharged from the second drum cleaning device, and wherein the transport path is configured to transport the residual first toner collected by the first toner collector and the residual second toner collected by the second toner collector.

4. The image forming apparatus according to claim 1, wherein the transport path comprises a passage forming member having a cylindrical inner structure.

5. An image forming apparatus comprising:

a first image forming unit configured to form an image by using a first toner having a first average particle diameter;

a second image forming unit configured to form an image by using a second toner having a second average particle diameter that is greater than the first average particle diameter;

an intermediate transfer body configured to have the images formed by the first and second image forming units transferred thereon; and a transport path configured to transport residual first toner and residual second toner collected from the first and second image forming units and the intermediate transfer body, wherein the transport path is configured such that a position at which the residual first toner and the residual second toner are collected from the intermediate transfer body is located upstream of positions at which the residual first toner and the residual second to toner are collected from the first and second image forming units, respectively, in a transporting direction of the transport path.

6. The image forming apparatus according to claim 5, wherein the image forming apparatus has a cleaning mode for cleaning the transport path, and wherein, in the cleaning mode, a toner image to be collected is formed by the second image forming unit and transferred onto the intermediate transfer body, and the second toner that forms the toner image to be collected that has been transferred onto the intermediate transfer body is transported through the transport path.

7. The image forming apparatus according to claim 3, wherein the first image forming unit comprises:

a first developing device; and a first developer collector configured to collect excess first developer discharged from the first developing device, wherein the second image forming unit comprises:

a second developing device; and a second developer collector configured to collect excess second developer discharged from the second developing device, and wherein the transport path is configured to transport the excess first developer collected by the first developer collector and the excess second developer collected by the second developer collector.

8. The image forming apparatus according to claim 4, wherein the transport path comprises a screw auger that extends through the passage forming member.

* * * * *